United States Patent [19]

Semple

[11] 4,111,358

[45] Sep. 5, 1978

[54] OVEN CONTROL

[75] Inventor: Alexander M. Semple, Oakville, Canada

[73] Assignee: Ranco Incorporated, Columbus, Ohio

[21] Appl. No.: 780,270

[22] Filed: Mar. 23, 1977

[51] Int. Cl.[2] ..... F23N 1/00

[52] U.S. Cl. ..... 236/15 A; 219/398

[58] Field of Search ..... 236/15 A; 337/323, 311; 219/398

[56] References Cited

U.S. PATENT DOCUMENTS

| | | | |
|---|---|---|---|
| 2,310,543 | 2/1943 | Pearce | 236/15 A |
| 2,409,434 | 10/1946 | Jacobs | 236/15 A |
| 2,541,314 | 2/1951 | Weber et al. | 219/398 |

*Primary Examiner*—William E. Wayner

*Attorney, Agent, or Firm*—Watts, Hoffmann, Fisher & Heinke Co.

[57] ABSTRACT

A control for cooking ovens having bake and broil burners is disclosed which includes a support base, three switches supported by the base which are electrically connected in controlling circuits for the burners, a manually operable selector mechanism for selecting desired oven functions and oven temperature levels, a thermostatic actuator which coacts with first and second of the switches and the selector mechanism to govern burner operation in response to sensed temperature levels, and an oven function control actuator which coacts with a plurality of the switches and the selector mechanism for enabling operation of the selected burners.

The selector mechanism includes an operating member which is supported by the base for rotation about an axis by a control knob or dial. The function control actuator includes a cam member supported for rotation by the operating member and a cam blade supported for rotation by the cam member as well as for tipping or rocking motion by the cam member. The cam member and cam blade are related to each other for lost motion rotation so that the cam blade is rotated by the cam member during a portion of the latter's travel and the cam blade, when rotated, is effective to change the oven function by altering the condition of one switch. A lever member is supported along one face of the cam blade and the lever member is shifted by the cam blade during its tipping motion to change the operational condition of another switch.

7 Claims, 10 Drawing Figures

OVEN CONTROL

BACKGROUND OF THE INVENTION

1. Field of the Invention

The present invention relates to oven controls and more particularly relates to cooking oven controls which govern both the oven function and the oven temperature by operation of a single manually settable knob or dial.

2. The Prior Art

Cooking ovens generally contain a burner, or heating element, at the bottom of the oven which is operated to heat the oven air for "baking" food and a burner at the top of the oven providing a radiant heating source for "broiling" food. The "bake" burner, whether it be an electric element or a gas burner, is normally cycled "on" and "off" to maintain a predetermined sensed oven air temperature level. In many ovens the "broil" burner is also capable of being controlled thermostatically.

In the past ovens have been provided with dual controls, one, sometimes called a "change over control," for enabling selection of the desired oven function (i.e., baking or broiling), the other for enabling selection of a desired oven air set point temperature. The use of dual controls of the character referred to has had the undesirable effect of increasing the volume occupied by the controls in the oven chassis as well as increasing the cost of the ovens.

Oven controls have been proposed which enable both oven function and oven temperature selection by a single control unit. These control units have had a single control knob or dial which is manually operated to govern the selection of the oven function and to establish the desired oven air temperature to be maintained while that function is performed. Compared to dual controls the single control units have, generally speaking, reduced the amount of space occupied by the controls and have reduced that portion of the oven cost attributable to controls.

Single knob oven controls have employed a knob which is rotatable from an oven "off" position through a range of angular movement during which the bake burner is operated. Within this range of motion the knob is positionable to select any desired oven temperature set point level. When the knob is turned further to approach the limit of its travel remote from the "off" position, operation of the bake burner is terminated and the broil burner is operated.

The prior art controls have been constructed and arranged to enable the maintenance of set point oven temperatures by the broil burner. To accomplish this the knob has been returned from the "broil" section of its travel to a desired oven temperature setting. Whenever the knob is turned to the "off" position the control is reset so that the broil burner is reactivated only when the knob is next turned to the "broil" section of its range of travel.

Additional capabilities have been built into the single knob oven controls. For example, in some installations rapid "preheating" of the oven is desirable and in these ovens the control switches for the bake and broil burners have been related so that when the control is turned "on" to perform a baking function both the broil and bake burners are operated until the sensed oven temperature approaches the set point temperature at which time the "broil" burner is deactivated.

The controls which have been utilized to govern the operation of the ovens have often been difficult to assemble, composed of a relatively large number of parts and, because the amount of space available within the cooking stove chassis is always at a premium, have tended to be undesirably large or "deep", i.e. extend too far into the chassis from the control mounting panel.

SUMMARY OF THE INVENTION

The present invention provides a new and improved single knob oven control which is of simple, easily manufactured construction which enables the control to be shaped more efficiently than the prior art controls.

In accordance with a preferred embodiment of the invention, the new control comprises a support base, three switches supported by the base for governing operation of oven bake and broil burners, a manually operated selector mechanism for enabling selection of desired oven functions and oven temperature levels, a thermostatic actuator for governing switch operation in response to sensed oven temperature levels and a function control actuator which is cooperable with a plurality of the switches and the selector mechanism for enabling performance of desired oven functions. The function control actuator includes a cam member supported for rotation by the selector mechanism and a cam blade supported adjacent and in confronting relationship with the cam member. The cam blade is engageable by the cam member so that lost motion rotation is imparted to the cam blade through a predetermined angular displacement of the cam member. The cam blade is also engageable by the cam member for imparting rocking or tilting motion to the cam blade. The cam blade effects a change of the operational condition of one switch during rotation by the cam member and is effective to change the operational condition of another switch in response to rocking motion by the cam member.

In one embodiment of the invention when the oven control knob is moved to its "off" position the cam member engages the cam blade at a location spaced from the axis of rotation and tips the cam blade so that a portion of the cam blade moves in a direction generally parallel to the axis to effect operation of one control switch to prevent operation of the burners. When the control knob is moved away from its "off" position, the cam member rotates relative to the cam blade and the cam blade rocks to a position where the switch is actuated to permit operation of the burners.

The cam member is rotatable relative to the cam blade until the control knob is moved into the "broil" section of its travel at which time the cam member rotates the cam blade to effect operation of a bake burner control switch to disable the "bake" burner. The control switch governing operation of the bake burner is positively opened so that the bake burner can no longer heat the oven and the broil burner is rendered effective.

When the control knob is turned back toward its "off" position the cam member moves relative to the cam blade. Thus the bake burner controlling switch remains opened by the operation of the cam blade. When the control knob is turned to its "off" position the cam member again engages and moves the cam blade so that the bake burner control switch is reclosed.

In the preferred embodiment of the invention the cam blade is associated with detent forming structure which maintains the cam blade in its "off" position as the cam member is rotated from the "off" toward the broil position as well as for maintaining the cam blade in its broil position while the cam member is rotated from the broil position back toward its "off" position. The detent structure also aids in providing a tactile indication that the control is conditioned to turn the oven off or that the oven is in its broiling mode; that is to say the user can "feel" when the control has been so conditioned. The control body is provided with suitable stops for limiting the extent of rotation of the cam blade and the cam member.

In accordance with a preferred and illustrated embodiment of the invention, the cam blade and cam member are assembled in confronting relationship about their axis of rotation and are maintained in an assembled relationship by an overlying lever member which is urged into engagement with the cam blade by an assembly spring. The detent structure is formed by interfitting projections and recesses formed on the lever member and the cam blade and the assembly spring resiliently biases the projections and recesses to their interfitting positions.

The lever member is fixed against rotation and extends radially beyond the cam blade for engagement with a switch operating plunger. The lever member is rocked by the cam blade as the operating knob is moved to and from its "off" position so that the rocking motion of the cam blade is transmitted to the control switch via the lever member.

An oven control embodying the invention can be used to govern the operation of either an electric or gas oven but in the illustrated and preferred embodiment the control governs the application of electrical power to the burners in an electric oven.

Other features and advantages of the invention will become apparent from the following detailed description of a preferred embodiment made with reference to the accompanying drawings which form a part of the specification.

DESCRIPTION OF A PREFERRED EMBODIMENT

Figure 1:
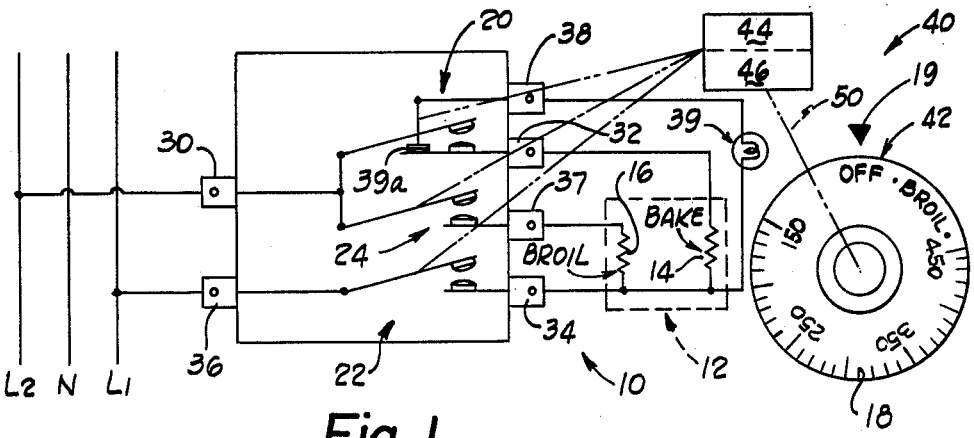
FIG. 1 is a schematic illustration of a burner control embodying the present invention operatively associated with the burners in an electric cooking oven.

An oven control 10 embodying the present invention is schematically shown in FIG. 1 associated with a cooking oven 12 having a "bake" element, or burner, 14 and a "broil" element, or burner, 16 disposed within the oven enclosure. The oven 12 and the burners 14, 16 are schematically illustrated and may be of any suitable or conventional construction in which the broil burner is located in the oven space in such a way as to heat food in the oven primarily by radiant heating while the bake burner 14 is located for heating the food primarily by convection and does not direct appreciable radiant heat to the food.

The control 10 is constructed and arranged to control both the oven function and temperature, that is to say, the control enables the oven to be turned "on" and "off", provides for manual selection of which burner shall operate, and establishes and maintains desired oven compartment temperature levels. The control is preferably mounted to a supporting panel of the oven and has a control knob, or dial, 18 which bears indicia for indicating oven function and temperature settings. The knob indicia are alignable with a registration mark, indicated by the reference character 19, on the oven panel by rotating the knob.

When the knob is rotated from its "off" position to a position where a given temperature marked on the knob is aligned with the registration mark 19 the oven is heated up approximately to the set temperature and is maintained substantially at the set temperature by cyclic operation of the burner. When the knob 18 is rotated so that its "broil" marking is aligned with the registration mark 19 the bake burner is disabled and the broil burner operates. If the knob is then rotated back towards its "off" position to a temperature setting, the oven continues being heated by solely the broil burner and the broil burner is cyclically operated to maintain an elevated oven temperature. Returning the knob to its "off" position turns off the oven burners and enables the bake burner to be operated when the oven is next turned "on".

In the illustrated and preferred embodiment the control 10 is associated with a split phase alternating current power supply schematically illustrated by lines L1, L2 and N. For the purposes of this description the voltage across the lines L1 and L2 may be assumed to be approximately 240 volts while the voltage across the lines L2 and N, and L1 and N is approximately 120 volts. The line N is connected to a suitable electrical ground.

The control 10 includes control switch assemblies 20, 22 and 24 which control energization of the burners 14, 16. The switch assembly 20, referred to as the "bake switch", controls the operation of the bake burner 14 via a circuit from the line L2 through a terminal post 30 the contacts of the switch 20, a terminal post 32, the bake element 14, the terminal post 34, the contacts of the switch 22 and to the line L1 via a terminal post 36. The bake burner is energized only when the switch 20 and the switch 22 are closed to complete its energizing circuit.

The switch 24, referred to as the "broil" switch, controls operation of the broil burner by completing and interrupting an energization circuit for the broil burner from the line L2 through the terminal 30, the contacts of the switch 24, a terminal post 37, the broil burner 16, the terminal 34 and to the line L1 through the contacts of the switch 22 and the terminal 36.

The illustrated switch 22 is an "on-off" switch in that it is opened to interrupt the power supply to both oven burners when the knob is in its "off" position. The switch 22 must be closed in order for the oven to operate at all and in the illustrated construction the switch 22 is closed whenever the knob is away from its "off" position.

The preferred control 10 is also associated with a pilot light 39 which is lit whenever the oven is operating. The pilot light energizing circuit includes a controlling switch 39a and a terminal 38 so that the pilot light energizing circuit is connected across the lines L1 and L2 whenever the oven control knob is away from the "off" position.

The control 10 includes a switch actuator system 40 which governs the operation of the control switch assemblies 20, 22, 24 so that the oven 12 performs desired functions and is maintained at appropriate desired temperature levels. The actuator system 40 comprises a manual function and temperature selector 42, a thermostatic actuator 44 and an oven function control actuator 46, all of which are schematically illustrated in FIG. 1. The function and temperature selector system 42, in the preferred embodiment, comprises the knob 18 and an operating shaft assembly 50 which is driven by the knob to condition the actuators 44, 46.

The thermostatic actuator 44 preferably includes a bellows, or a similar expansible power element, 54 (See FIG. 7) which defines an expansible chamber communicating with a sealed fixed volume bulb via a capillary tube. The bulb, tube and bellows are filled with a thermally expansible and contractable liquid and the bulb is placed at a suitable location in the oven so that heat transfer between the oven air and the bulb results in the liquid volume changing in relation to the oven air temperature changes and expanding or contracting the bellows. The bellows is acted upon by a spring 54a (FIG. 7) which acts to assure that the bellows tends to collapse to reduce its volume when the liquid volume is reduced. The bulb and capillary tube are of conventional construction and not shown in detail or described further. The motion of the thermostatic actuator upon expansion or contraction of the liquid volume is transmitted to the switches 20, 24 via an operating plunger 55.

The oven function control actuator 46 is associated with the switches 20, 22 to coordinate their operation with that of the selector system knob 18. The operation of the function control actuator 46 is transmitted to the on off switch 22 and the bake switch 20 via respective operating plungers 56, 58 (Shown schematically by FIGS. 2–6).

The control schematically illustrated by FIG. 1 is constructed and arranged to provide the following oven functions:

(a) a positive "off" condition,
(b) rapid oven preheating to a desired "bake" temperature level,
(c) thermostatically controlled operation of the bake burner through the normal range of baking temperatures, and
(d) thermostatically controlled operation of the broil burner throughout the entire range of oven operating temperatures.

FIGS. 2–6 illustrate various operating conditions of the control switch assemblies 20, 22 and 24 under the control of the switch actuator system 40. The switches 20, 22 and 24 are schematically illustrated by the drawing and may be of any suitable or conventional construction consistent with the operating requirements imposed by the oven and the operation of the control 10. The illustrated switches are slow make and break single throw switches. The bake switch assembly 20 is formed by a moving contact 20a, a fixed contact 20b and a resilient conductive blade 20c which supports the moving contact. The blade 20c is constructed so that it normally biases the contacts 20a, 20b toward engagement with each other. The on-off switch assembly 22 includes a moving contact 22a, a fixed contact 22b and a resilient conductive contact supporting blade 22c for the contact 22a. The blade 22c is constructed to bias the contact 22a toward engagement with the contact 22b and the contacts of the switch 22 tend to be closed. The broil switch assembly 24 includes a moving contact 24a, a fixed contact 24b and a resilient conductive blade 24c which supports the contact 24a and normally urges it toward engagement with the contact 24b.

The thermostatic actuator actuates the broil switch contact blade 24c directly via the plunger 55 and the motion of the plunger 55 is transmitted to the bake switch contact blade 20c via the broil switch contact blade. An articulating member 60 is disposed between the bake contact blade 20c and the broil contact blade 24c for coordinating their operation. In the preferred and illustrated embodiment the articulating member 60 is formed by a set screw which is threaded to the bake switch blade 20c and extends toward abutting contact with the broil switch blade 24c. The articulating member 60 transfers motion from the broil switch blade to the bake switch contact blade when the broil switch blade moves relatively toward the bake switch blade.

Figure 2:
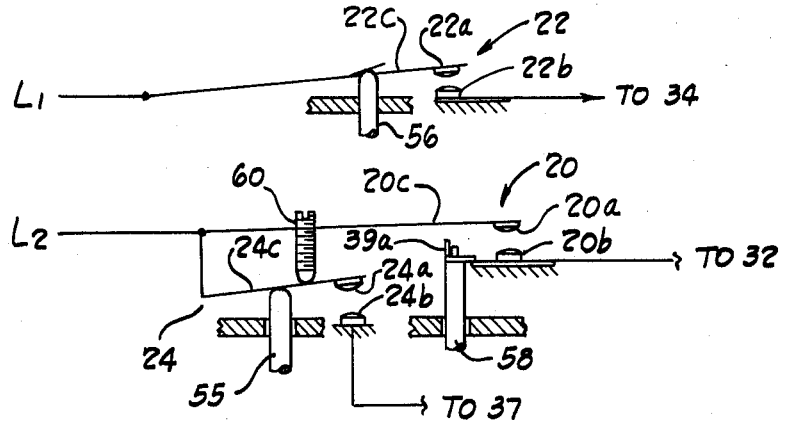
FIGS. 2–6 are schematic illustrations of portions of the oven control illustrated in FIG. 1 with the parts shown in different operating positions.

Referring particularly to FIG. 2 the control 10 is illustrated in its "off" condition. The function control operating plunger 56 has shifted the on-off switch contact blade 22c to open the contacts 22a, 22b so that the burners can not be energized. The thermostatic operating plunger 55 engages the broil switch contact blade 24c to open the broil switch contacts. In addition the articulating member 60 has transferred the motion of the broil switch contact blade to the bake switch blade to open the bake switch contacts.

When the control 10 is turned on to a bake condition the oven is rapidly pre-heated. When the knob 18 is rotated from its "off" position to align the oven registration mark 19 with a desired oven temperature set point level indicated on the knob periphery, the plunger 56 is retracted from the on-off switch blade 22c permitting the contacts 22a, 22b to close. This enables power to be supplied to the burners. At the same time rotation of the knob sets the thermostatic actuator 44 to maintain the set point temperature. Assuming the oven air temperature to be lower than the set point temperature, the thermostatic actuator is positioned so that the plunger 55 is shifted away from the broil switch contact blade 24c sufficiently to allow both the bake and the broil switches to close. Accordingly, current flows to both the bake burner and the broil burner. This condition of the control 10 is illustrated by FIG. 3 and the oven is rapidly heated toward its set point temperature by virtue of both the broil and bake burners operating.

Figure 3:
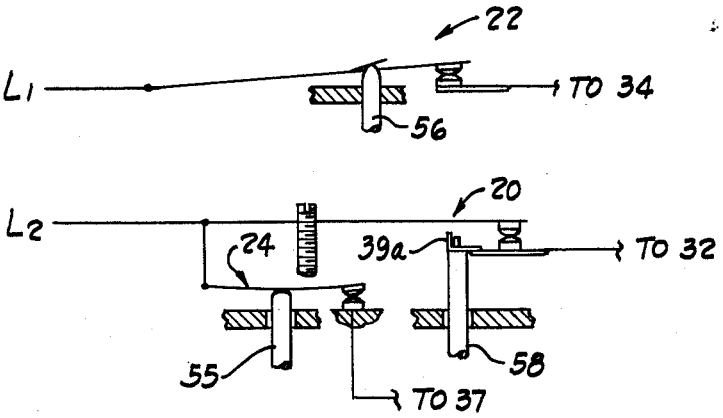

It should be noted in connection with FIG. 3 that the broil switch contact blade 24c is spaced from the articulating member 60. This allows the broil switch blade to be shifted by the thermostatic plunger independantly from the bake switch blade when the sensed temperature is at a pre-determined level below the set point temperature.

As the oven temperature approaches the set point level the broil burner is deenergized. The thermostatic operating plunger 55 advances toward and engages the broil switch blade 24c. The blade 24c is shifted to open the contacts 24a, 24b and deenergize the broil burner. The broil burner is preferably deenergized at an oven temperature level about 15°-20° F. below the set point temperature.

Figure 4:
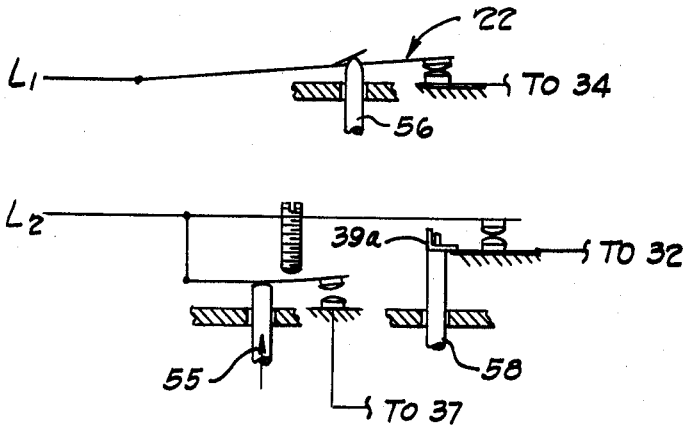

The broil switch contact blade 24c is shifted to open the contacts 24a, 24b without engaging the articulating member 60 and accordingly the bake switch remains closed after the broil switch is opened. This condition of the control is illustrated by FIG. 4 of the drawings.

Figure 5:
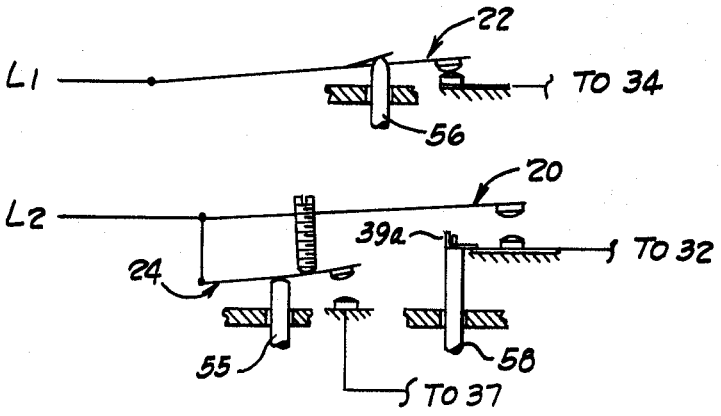

When the oven air temperature has reached the set point temperature the thermostatic actuator opens the bake switch and deenergizes the bake burner. This condition of the control is illustrated by FIG. 5 from which it can be seen that the thermostatic operating plunger 55 has shifted the broil switch contact blade 24c against the articulating member 60 so that the broil switch blade movement is transferred to the bake switch blade 20c. The bake burner remains deenergized until the sensed oven temperature has declined sufficiently that the plunger 55 retracts and allows the bake switch contacts to reclose. The bake burner is cycled between its energized and deenergized conditions in the manner described so long as the oven function control actuator 46 is conditioned to enable the oven to perform baking operations.

Figure 6:
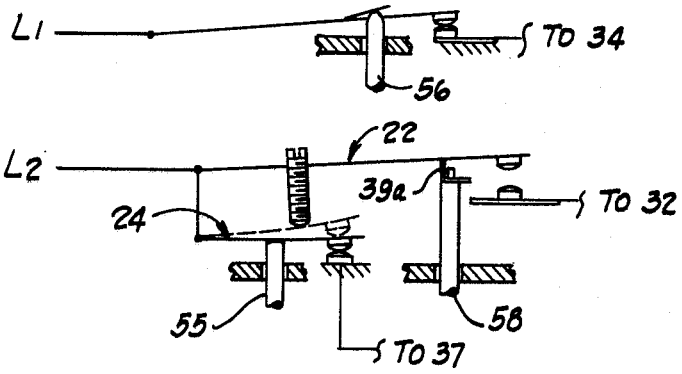

FIG. 6 illustrates the condition of the control switches when the knob 18 is turned to condition the oven 12 for broiling. The thermostatic actuator 44 is conditioned to permit maximum oven temperature while the function control actuator 46 shifts the operating plunger 58 into engagement with the bake switch contact blade 59 deenergize the bake burner. The bake switch contacts are opened by the plunger independantly of the broil switch blade 24c and the thermostat can only be satisfied by operation of the broil burner via closing of the broil switch contacts.

The operating plunger 58 is latched in the position shown in FIG. 6 so that the knob 18 may be turned back from the "broil" section of its travel into the "bake" range without the bake switch contacts reclosing and the bake burner being reenergized. The oven is then operated by cycling the broil burner since the thermostatic actuator plunger 55 remains effective to open and close the broil switch contacts in response to sensed oven air temperature levels. It should be noted that in the illustrated control the broil burner contacts 24a, 24b will be cycled open and closed at temperatures 15°-20° F. below the set-point temperature indicated by the position of the knob 18. This is not undesirable because of the radiant heating effect produced by the broil burner which is not produced by the bake burner.

The plunger 58 carries the pilot light control switch contact 39a. Whenever the bake switch contacts are closed the pilot contact is electrically connected to the fixed bake switch contact. When the bake switch contacts are latched open during broiling the contact 39a is transferred to electrically contact the moving bake switch contact so that the pilot light remains lit.

Figure 7:
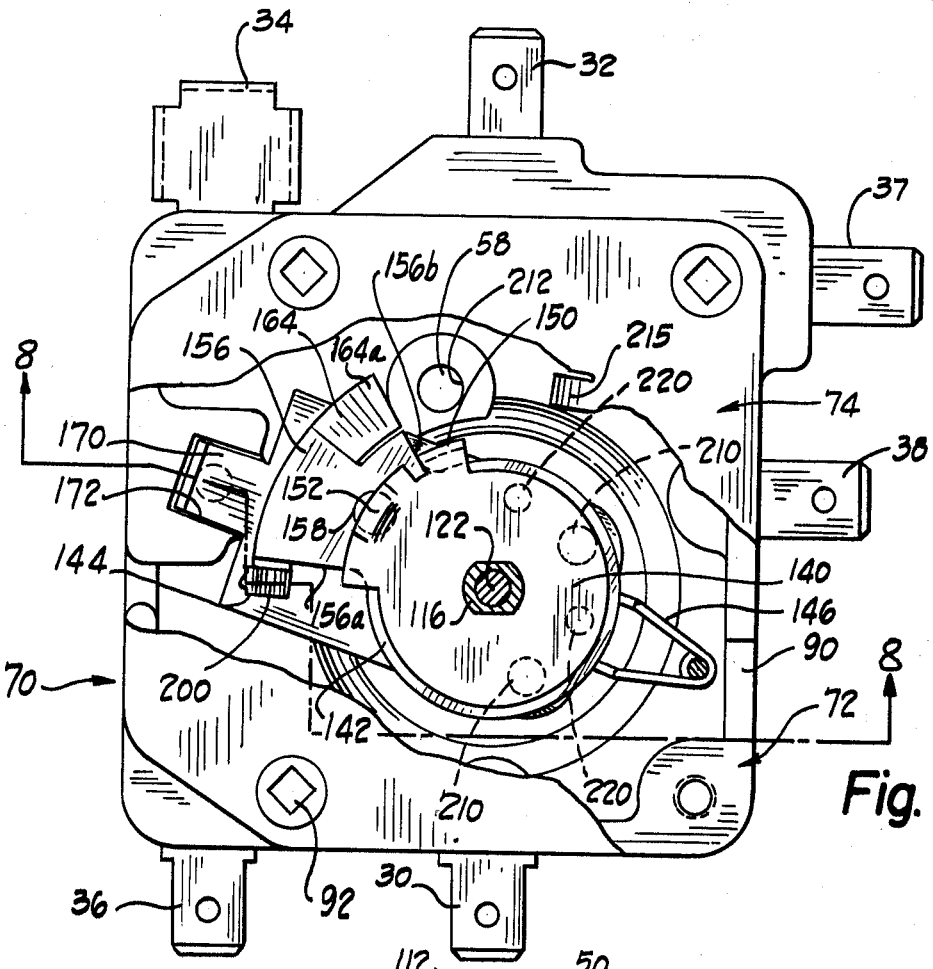
FIG. 7 is an elevational view of an oven control constructed according to a preferred embodiment of the invention with portions shown in cross-section and portions broken away.
Figure 8:
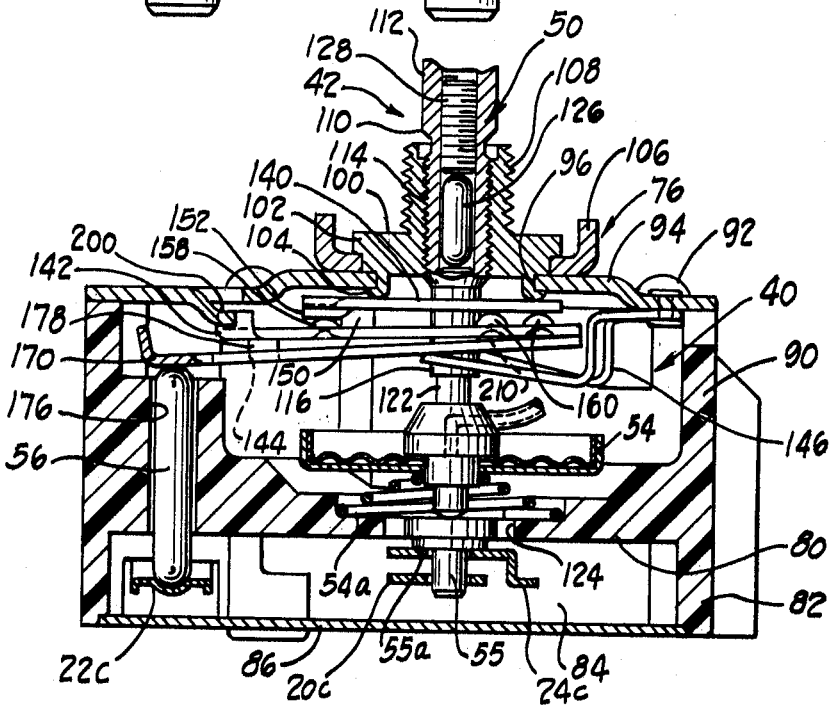
FIG. 8 is a cross-sectional view of the control of FIG. 7 seen from the plane indicated by the line 8—8 of FIG. 7.

Referring now to FIGS. 7 and 8, a preferred construction of the control 10 is illustrated as including a housing assembly 70 which is adapted to be connected to the oven panel and carries the control switches and the switch actuator system. The assembly 70 is formed by a molded body 72, a support plate 74 and a mounting member 76. The housing assembly is detachably supported on the oven panel by the mounting member 76.

The body 72 is preferably composed of a molded dielectric thermosetting plastic material forming a central transverse wall 80 (FIG. 8) having the switch actuator system 40 disposed on one side and the control switch assemblies disposed on its opposite side. The switch assemblies are electrically insulated from the actuator system. In the illustrated embodiment an integral flange 82 is formed circumferentially around the wall 80 on one side to define a chamber 84 in which the control switch assemblies 20, 22, 24 are supported. The chamber 84 is closed by a dielectric plate 86 which is supported by the flange 82. The terminal posts project outwardly from the chamber 84 at the juncture of the plate 86 and the flange 82 through conforming recesses in the flange.

The opposite side of the wall 80 defines a flange section 90 having integral support legs which extends from the wall 80 to the support plate 74. The support plate is attached to some of the legs by suitable fasteners 92, such as shelf tapping screws, so that the support plate is maintained in fixed, spaced relationship with respect to the wall 80.

In the preferred embodiment the support plate carries the mounting member 76. The plate 74 is formed by a rigid heavy gage sheet metal member which is generally rectangular and connected to the legs adjacent its corners by the fasteners 92. The plate 74 has a section 94 which is embossed outwardly from the transverse wall 80 and surrounds an aperture 96 in which the mounting member 76 is supported.

The mounting member 76 is constructed for connecting the control 10 to the oven panel and carries the actuator system 40. The mounting member is preferably formed by a tubular body 100 having a circumferential flange 102 disposed adjacent the plate 74 and a collar section 104 which extends from the flange 102 through the aperture 96. The projecting end of the collar 104 is flared outwardly and peened over so that the support plate is securely gripped between the flange 102 and the collar end. A mounting bracket 106 (only a portion of which is shown) is secured about the periphery of the flange 102 and the tubular body 100 has external mounting threads 108 formed on it which coact with suitable installation nuts, not shown. The mounting bracket 106 and threads 108 function to mount the control 10 to the supporting oven panel.

The function and temperature selector system is supported by the mounting member 76. More particularly the operating shaft assembly 50 is threaded to the mounting member 76 so that when the knob 18 is rotated the operating assembly 50 is both rotated and shifted axially toward or away from the transverse housing wall 80. The axial motion of the operating shaft assembly is effective to set the thermostatic actuator to control the operation of the bake and broil control switches 20, 24 while rotational motion of the shaft assembly governs the oven function control actuator 46. In a preferred embodiment the shaft assembly 50 includes a tubular shaft 110 having a knob supporting end portion 112 projecting outwardly from the mounting member 76, a threaded barrel section 114 which is threaded into the mounting member 76 and an inwardly projecting end 116 which is disposed between the support plate 74 and the housing wall 80.

The bellows 54 is supported by the operating shaft end section 116 and is interposed between the shaft end 116 and the operating plunger 55 adjacent the housing wall 80. In the preferred and illustrated control the return spring 54a is a helically coiled spiral spring and reacts between the bellows and the wall 80 for urging the bellows toward the shaft. As the shaft 110 is turned by the knob 18 the shaft is threaded into or out of the mounting member 76 and the bellows is correspondingly moved toward or away from the broil switch blade. This motion establishes the set point oven temperature levels at which the bellows operates the control switches.

In the illustrated control the bellows carries a projecting mounting pin 122 which extends into a conforming bore in the shaft end 116 and rigidly engages the shaft so that upon expansion or contraction of the bellows the bellows displacement occurs in a direction away from the shaft end. The plunger 55 is supported for movement through an opening 124 in the housing wall 80 and has a projecting guide pin portion extending through an opening in the broil switch blade and a shoulder **55*a* abutting the switch blade for transmitting actuating force to the switch blade. When the switch blade is stressed the plunger is maintained in contact with the bellows 54 by the biasing force of the switch blade 24*c***.

The axial spatial relationship between the bellows and the control shaft is adjustable to enable calibration of the control. In the illustrated and preferred embodiment the axial relationship between the bellows 54 and the shaft 110 is controlled by a bearing 126 and a set screw 128 which are disposed in the shaft bore. The bellows pin 122 rigidly engages the bearing 126 so that the bearing location in the shaft governs the controls response to sensed oven temperatures. The set screw 128 is supported by a threaded section of the shaft bore and governs the position of the bearing 126. The set screw is adjustably positioned to calibrate the control during its manufacture.

The function control actuator is driven by rotation of the shaft 110 to coordinate operation of the control switches with the position of the knob 18 relative to the oven panel. The function control actuator includes a cam member 140, a cam blade 142, a level member 144 and an assembly spring 146. The cam blade 142 is disposed between the cam member 140 and the level 144 in a sandwich-like assembly which is resiliently clamped against the support plate 74 by the spring 146. The cam blade and cam member are related by a lost motion connection by which the cam blade is rotated by the cam member during only a portion of the cam member's rotational displacement about the shaft axis. The cam blade is moved by the cam member to actuate the plunger 58 to enable or disable operation of the bake control switch assembly 20. The cam blade and cam member also coact so that the cam blade is rocked, or tipped, relative to the cam member to control operation of the switch assembly 22 via the plunger 56.

The cam member 140 is rotatably driven by the shaft 110 about the shaft axis when the knob is rotated. The preferred cam member 140 is a thin generally circular sheet metal member which surrounds the shaft end section 116 and bears against the peened over collar of the mounting member 76. The shaft end section has opposed axially extending flats and the cam member defines a conforming central opening through which the shaft end section extends. The shaft end section is therefore keyed to the cam member for rotation while enabling axial relative movement between the cam member and the shaft.

The cam member provides separate structural elements for engaging and operating the cam blade. The illustrated cam member defines a bent over tab portion 150 which projects from its periphery through the plane of the adjacent cam blade and an embossed lobe section 152 which extends from the plane of the cam member toward the cam blade.

The cam blade 142 has a flat generally circular control body portion which loosely surrounds the shaft section 116. A sector shaped cam reaction section 156 projects radially from the control body for reaction with the cam member. The reaction section defines an embossed cam follower 158 which projects toward engagement with cam member lobe 152 when the cam blade is rocked, and the opposite radial edges **156*a*, 156*b* of the reaction section 156 provide abutments for the cam member tab portion 150** when the cam blade is driven by the cam member.

The cam blade is supported adjacent and in confronting relationship with the cam member and is urged toward engagement with cam member by the assembly spring 146. The cam blade body has embossed generally semispherical legs, or standoffs, 160, which bear on the cam member and permit low friction relative rotation between the cam member and the cam blade. An embossed cam ramp 164 is formed along the periphery of the reaction section 156 and extends toward engagement with the support plate 74 along the boundary of the embossed section 94. The end of the cam ramp forms a narrow planar surface **164*a* which, when it bears on the support plate 74, provides with the legs 160**, a three point support for the cam blade by which the cam blade is disposed in a plane generally parallel to that of the cam member.

The level 144 is formed by a generally rectangular sheet metal member which overlies the cam blade and has an aperture through which the shaft 110 loosely extends. The lever extends away from the shaft axis and defines a projecting ear-like end portion 170 which is loosely received in a slot 172 formed by the housing flange 90. The slot 172 extends parallel to the control shaft axis and thus permits motion of the lever end section in the direction of the shaft axis while preventing rotation of the lever end section about the shaft axis. The lever end section engages the switch operating plunger 56 which is slidably supported in a guide bore 176 extending between the control switch blade **22*c* and the lever end section. The lever has an embossed follower portion 178 which extends from the plane of the lever toward the support plate 74. The cam blade reaction section 156 engages the follower 178 when the lever is shifted to operate the control switch 22**.

The assembly spring 146 is preferably a generally hairpin shaped wire spring which is attached to the support plate 74 by a suitable connector, such as a rivet, so that its arms extend toward and resiliently engage the lever 144 on opposite sides of the shaft end section. The spring arms provide a relatively strong biasing force for maintaining the parts of the actuator assembled as well as for producing spring return forces for the lever and cam plate.

FIGS. 7 and 8 illustrate the control 10 in its "oven off" condition. The shaft 110 is rotated and advanced towards the bellows 54 so that the bellows is completely collapsed and the bake and broil switches are opened. The cam member 140 is rotated by the shaft and drives the cam blade 142 to a position where the abutment **156*a* engages a stop 200 formed by an inwardly struck ear on the support plate 74. In this position the cam member lobe section 152 engages the follower 158 so that the blade is rocked, or tipped, relative to the cam member. Furthermore the lever follower portion 178 rides onto the cam blade reaction section 156 so that the lever member tips relative to the cam blade. The result is a pronounced tipping of the lever member relative to the cam member which opens the control switch 22**.

When "baking" is desired the knob 18 is turned from the "off" position to a desired temperature set point level. This rotates the cam member 140 from its position illustrated by FIGS. 7 and 8 relative to the cam blade and the lever member. Rotation of the cam member results in the cam member lobe 152 moving out of engagement with the cam blade follower 158 so that the cam blade and the lever member are rocked back towards the support plate 74 allowing the control switch contacts 22*a*, 22*b* to close and permit operation of the oven burners. The lever and cam blade assume positions generally parallel to the cam member (See FIG. 9).

At the same time, axial movement of the shaft 110 shifts the bellows to permit the bake and broil switch contacts to close to initiate rapid oven pre-heating.

A detent arrangment is provided for releasably locking the cam blade against rotation with the cam member when the control knob is turned from its "off" position. The preferred lever member is provided with embossed legs 210 which align and interfit with recesses in the cam blade formed by the concave embossed cam blade legs 160 (FIGS. 7 and 8). The lever legs 210 are urged into the cam blade recesses by the assembly spring biasing force and resist rotation of the cam blade relative to the lever member with greater force than the frictional force tending to rotate the cam blade with the cam member.

The cam blade and cam member have a lost motion relationship when the cam member is positioned away from the opposite limits of its rotational travel, i.e. when the knob is between its "off" and "broil" positions. Consequently the rotational position of the cam blade 142 remains the same as in the "off" position (illustrated by FIG. 7) as the knob 18 is turned from the "off" position through the full range of "bake" set point temperatures.

Figure 9:
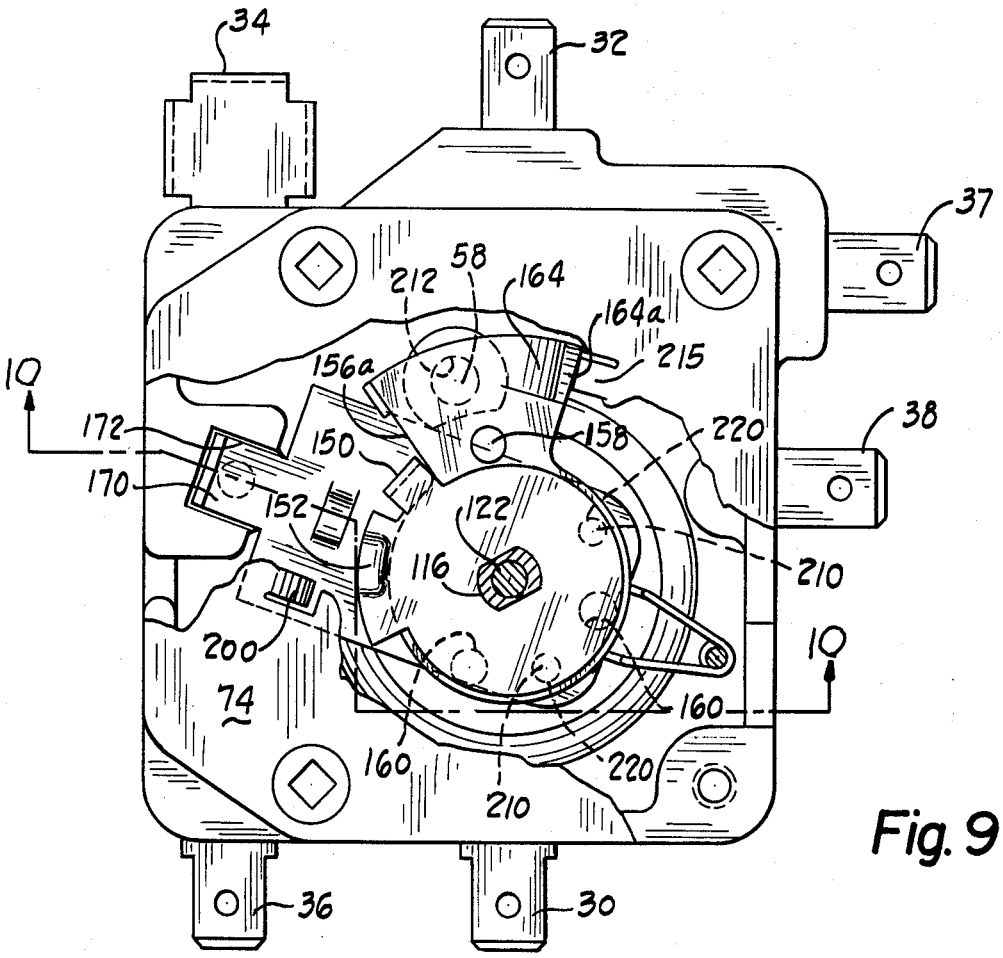
FIG. 9 is an elevational view similar to FIG. 7 with parts shown in different operating positions.
Figure 10:
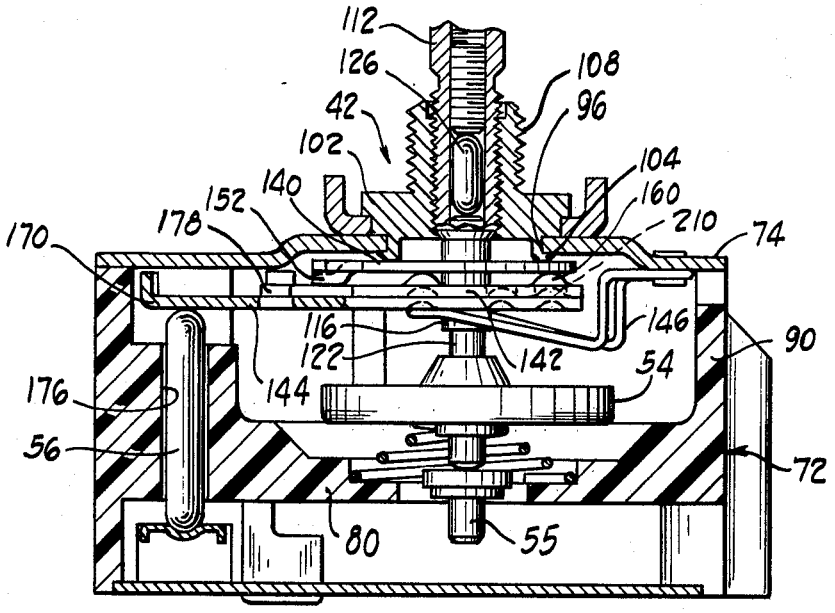
FIG. 10 is a cross-sectional view seen approximately from the plane indicated by the line 10—10 of FIG. 9.

The cam blade is rotated by the cam member to disengage the "bake" burner control switch contacts when the knob 18 is shifted into the "broil" section of its travel. Referring to FIGS. 9 and 10, the control is illustrated in its "broil" condition with the cam blade having rotated about the shaft axis to engage and actuate the plunger 58 so that the bake switch is positively opened. When the knob 18 is rotated to the "broil" position the cam member tab 150 engages the cam blade abutment 156*a* so that the cam blade is positively driven by the cam member rotation. Consequently the lever member legs 210 are displaced out of the cam blade leg recesses and the cam blade is rotated relative to the lever by the cam member.

The cam blade ramp 164 moves in an arc along the support plate 74 and engages the plunger 58 to move the plunger toward the "bake" switch 20 so that the bake switch opens. The plunger 58 is preferably a plastic cylindrical pin having spherical ends and is disposed in a bore 212 extending through the housing wall 80. The plunger 58 extends from the switch blade 20*c* to the support plate 74 but is shifted toward the switch blade when the plunger end follows along the cam blade ramp 164. The cam ramp end portion 164*a* engages a stop formed by an inwardly struck tongue 215 on the support plate 74 (See FIG. 7) to limit further rotation of both the cam member and the cam plate.

If the knob 18 is returned from the broil section of its travel to a position for establishing a set point temperature the control 10 cycles the broil burner to maintain an elevated oven temperature while the bake burner remains inactive. The bake burner control switch is latched open by operation of a detent arrangment which is effective to condition the bake burner against operation until the control is reset by turning the knob 18 substantially to its "off" position. In the illustrated embodiment the lever member legs 210 drop into respective cam blade apertures 220 when the cam blade is in the broil position. The engagement of the lever legs 210 with the apertures resists further relative rotation between the lever and the cam blade so that as the cam member rotates back towards its "off" position the cam blade remains in its broil position, i.e. lost motion occurs between the cam member and the cam blade. This maintains the bake switch open as a result of continued depression of the plunger 58 by the cam blade.

Resetting the bake switch is accomplished by rotating the knob 18 back to its "off" position. When this occurs the cam member tab 150 engages the cam blade abutment 156*b* and the cam blade is forced to rotate with the cam member. The lever member legs are lifted from the cam blade apertures 220 against the force of the assembly spring during this motion of the cam blade and cam member. When the knob is in its "off" position the cam member, cam blade and lever member are again positioned as illustrated by FIG. 7.

While only one preferred embodiment of the invention has been illustrated and described in detail, the present invention is not to be considered limited to the precise construction disclosed. Various adaptations, modifications and uses of the invention may occur to those skilled in the art to which the invention relates and the intention is to cover all such adaptations, modifications and uses which fall within the scope or spirit of the appended claims.

What is claimed is:

1. A control device for a cooking oven having bake and broil burners, the control comprising:

(a) a support base, (b) three switches supported by said base and electrically connected in control circuits for the oven burners;

(c) manually operable selector means for selecting desired oven functions and oven temperature levels, said selector means comprising an operating member supported for rotation relative to said base;

(d) a thermostatic actuator supported by said base and cooperable with first and second of said switches and said selector means to govern burner operation in response to sensed oven temperature levels; and (e) an oven function control actuator supported by said base and cooperable with a plurality of said switches and said operating member for enabling desired oven burner operation, said function control actuator comprising:

(i) a cam member supported for rotation by said operating member about an axis;

(ii) a cam blade supported adjacent said cam member in confronting relationship therewith and having a portion by which rotation is imparted to said cam blade from said cam member to drive said cam blade through a predetermined angular displacement about said axis and a second portion by which tilting motion is imparted to said cam blade from said cam member;

(iii) said cam blade effective to change the operational condition of one of said switches during rotation thereof by said cam member about said axis and effective to change the operational condition of another of said switches in response to tilting motion thereof.

2. The control claimed in claim 1 further including a lever member disposed in confronting relationship with said cam blade member and supported against rotation about said axis, said lever member tilted in response to effect operation of said another switch.

3. The control claimed in claim 2 further comprising structure providing for lost motion rotation between said cam blade and said cam member, said structure comprising coacting abutments on said cam blade member and said cam member and detent means for preventing rotation of said cam blade member with said cam member when said abutments are disengaged.

4. The control claimed in claim 3 wherein said detent means comprise at least a projection formed on one of said cam blade and lever members and the other of said members defining projection receiving structure, said projection interfitting with said receiving structure when said cam blade member is at the limits of said angular displacement.

5. The control claimed in claim 4 further including biasing means effective to urge said projection and receiving structure into interfitting relationship and to releasably resist relative rotation between said lever and cam blade members when said projection and receiving structure interfit.

6. The control claimed in claim 1 further comprising structure providing for lost motion rotation between said cam blade and said cam member, said structure comprising coacting abutments on said cam blade member and said cam member and detent means for preventing rotation of said cam blade member with said cam member when said abutments are disengaged.

7. The control claimed in claim 6 further including spring means for resiliently maintaining said cam and cam blade members in assembled relationship and providing the resilient spring force of said detent means.

* * * * *